US007210646B2

(12) United States Patent
Hsu

(10) Patent No.: US 7,210,646 B2
(45) Date of Patent: May 1, 2007

(54) CORD SEAT ASSEMBLY

(76) Inventor: Mu-Chuam Hsu, No.26, Lane 242, Section 3, Jhongjheng Road, Rende Township, Tainan County (TW)

( * ) Notice: Subject to any disclaimer, the term of this patent is extended or adjusted under 35 U.S.C. 154(b) by 0 days.

(21) Appl. No.: 11/114,852

(22) Filed: Apr. 26, 2005

(65) Prior Publication Data

US 2006/0237571 A1 Oct. 26, 2006

(51) Int. Cl.
*B65H 57/00* (2006.01)
*E06B 9/30* (2006.01)

(52) U.S. Cl. ..... 242/397; 242/398; 242/615.3; 242/566; 160/170

(58) Field of Classification Search ..... 242/377, 242/379, 397, 398, 615, 615.4, 615.3, 548, 242/566; 160/171, 170, 84.01, 84.04, 84.05, 160/84.06, 107, 168.1 R, 173 R, 176.1 R, 160/177 R, 193, 321
See application file for complete search history.

(56) References Cited

U.S. PATENT DOCUMENTS 4,623,012 A * 11/1986 Rude et al. ..... 160/243
4,697,629 A * 10/1987 Anderson ..... 160/177 R
5,228,491 A * 7/1993 Rude et al. ..... 160/171
5,267,598 A * 12/1993 Marocco ..... 160/177 R
5,908,062 A * 6/1999 Fun ..... 160/170
6,032,716 A * 3/2000 Mattey ..... 160/84.04
6,244,532 B1 * 6/2001 Watanabe ..... 242/399.1
6,536,503 B1 * 3/2003 Anderson et al. ..... 160/84.04
6,915,831 B2 * 7/2005 Anderson ..... 160/173 R
2004/0016517 A1 * 1/2004 Anderson ..... 160/173 R
2006/0000562 A1 * 1/2006 Liu ..... 160/173 R

* cited by examiner

*Primary Examiner*—Patrick Mackey
*Assistant Examiner*—William E. Dondero
(74) *Attorney, Agent, or Firm*—Charles E. Baxley

(57) ABSTRACT

A cord seat assembly includes a seat, a spool rotatably supported by the seat, and a cord. The seat includes an end wall and a through-hole in a bottom thereof. The cord extends through the through-hole of the seat. The cord is wound around the spool and includes an end fixed to a first end of the spool. The end wall of the seat includes a lateral extension wall extending from a side of the end wall along a lateral side of the seat. The lateral extension wall is adjacent to the through-hole and includes a guiding face facing a second end of the spool. The cord that has passed through the through-hole abuts against and is guided by the guiding face onto the spool when the spool is turned in the retrieving direction of the cord, avoiding the cord from overlapping or getting stuck.

4 Claims, 6 Drawing Sheets

CORD SEAT ASSEMBLY

BACKGROUND OF THE INVENTION

1. Field of the Invention

The present invention relates to a cord seat assembly. In particular, the present invention relates to a cord seat assembly for moving an object upward or downward.

2. Description of the Related Art

A conventional cord seat assembly comprises a cord for moving an object such as a curtain, Venetian blind, etc upward or downward. The cord is wound around a spool and movable in a retrieving direction and a releasing direction.

FIG. 6 of the drawings illustrates a conventional cord seat assembly comprising a seat 1', a substantially cylindrical spool 2', and a cord 3'. The seat 1' includes an axial hole 11' in each of two ends thereof through which an axle 21' of the spool 2' rotatably extends. The seat 1' further includes a through-hole 12' in a bottom thereof through which the cord 3' extends. Formed on an end of the spool 2' is a coupling section 22' to which an end of the cord 3' is fixed. A conic guiding section 23' is formed on the other end of the spool 2' and tapers toward the coupling section 22' of the spool 2'. When the spool 2' is turned in a retrieving direction of the cord 3', the cord 3' is wound around the spool 2' and moves toward the coupling section 22' due to provision of the conic guiding section 23', preventing the cord 3' from overlapping and getting stuck.

However, the conic guiding section 23' results in an increase in the overall size of the seat 1', which limits installation of the cord seat assembly and adversely affects the appearance when the cord seat assembly is mounted outdoors.

SUMMARY OF THE INVENTION

A cord seat assembly in accordance with the present invention comprises a seat, a spool rotatably supported by the seat, and a cord. The seat includes an end wall and a through-hole in a bottom thereof. The cord extends through the through-hole of the seat. The cord is wound around the spool and includes an end fixed to a first end of the spool. The cord is movable along a retrieving direction and a releasing direction.

The end wall of the seat comprises a lateral extension wall extending from a side of the end wall along a lateral side of the seat. The lateral extension wall is adjacent to the through-hole and includes a guiding face facing a second end of the spool. The cord that has passed through the through-hole abuts against and is guided by the guiding face onto the spool when the spool is turned in the retrieving direction of the cord. The cord is thus guided so as to be wound around the winding section of the spool in a smooth manner while avoiding the cord from overlapping or getting stuck.

Preferably, a distance between a relatively upper point on the guiding face and the through-hole is greater than that between a relatively lower point on the guiding face and the through-hole.

Preferably, the spool includes a substantially cylindrical winding section around which the cord is wound.

Preferably, the guiding section of the lateral wall extension includes an inner face facing the second end of the spool, and a distance between the inner face of the guiding section of the lateral wall extension and an outer periphery of the spool is smaller than a diameter of the cord.

Preferably, the end wall of the seat comprises another lateral extension wall extending from another side of the end wall opposite to the side of the end wall along another lateral side of the seat opposite to the lateral side of the seat. This lateral extension wall includes a guiding face facing the second end of the spool. The guiding face of this lateral extension wall guides the cord that has passed through the through-hole onto the spool when the spool is turned in the retrieving direction of the cord. Preferably, the cord comes into contact with the guiding face of this lateral extension wall after the cord has come into contact with the guiding face of the above-mentioned lateral extension wall.

Preferably, a distance between a relatively upper point on the guiding face of this lateral extension wall and the through-hole is smaller than that between a relatively lower-point on the guiding face on this lateral extension wall and the through-hole.

Preferably, the guiding section of this lateral wall extension includes an inner face facing the second end of the spool, and a distance between the inner face of the guiding section of this lateral wall extension and an outer periphery of the spool is smaller than a diameter of the cord.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
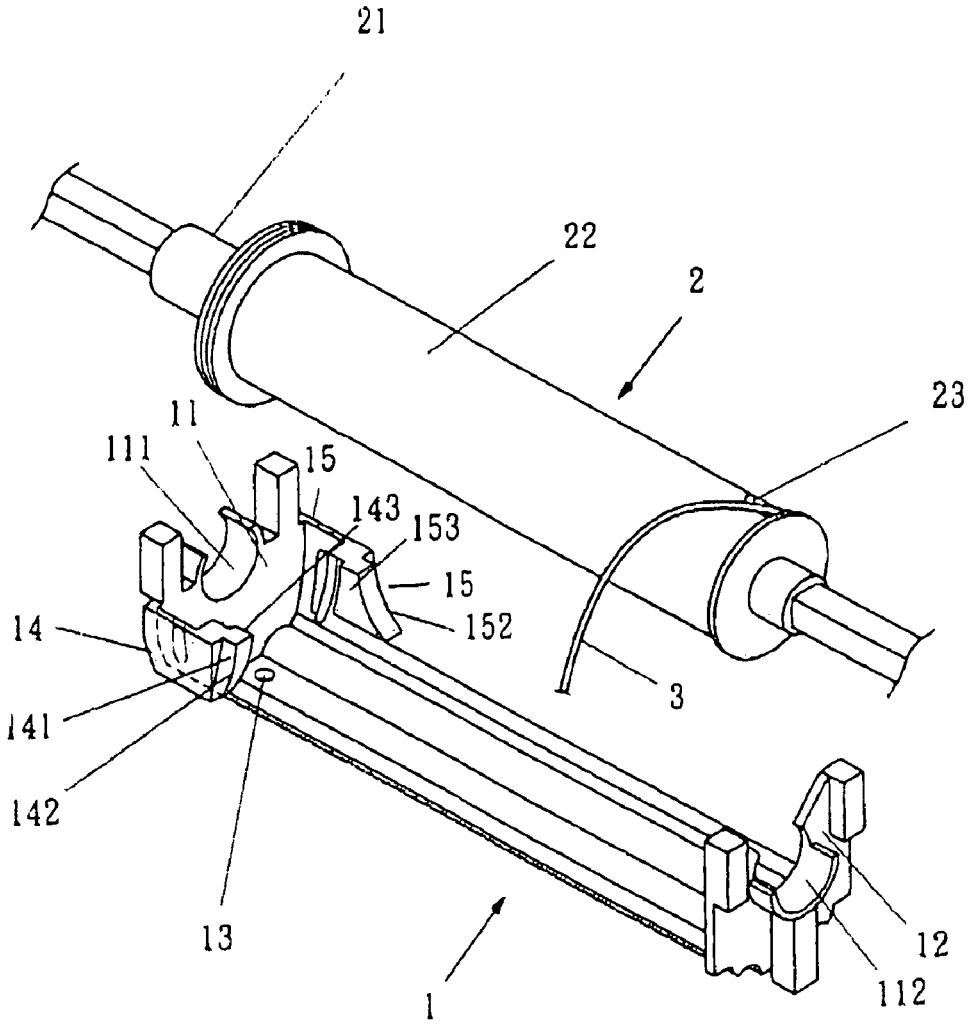
FIG. 1 is an exploded perspective view of a cord seat assembly in accordance with the present invention.

Referring to FIG. 1, a cord seat assembly in accordance with the present invention comprises a seat 1, a spool 2, and a cord 3. The spool 2 is rotatably supported by the seat 1. In the illustrated embodiment, the seat 1 includes an axial hole 111, 112 in each of two end walls 11 and 12 thereof. A through-hole 13 is defined in a bottom of the seat 1 and preferably adjacent to, e.g., the end wall 11.

The spool 2 includes a cord winding section 22 that is preferably cylindrical. The spool 2 further includes two axles 21 respectively on two sides of the cord winding section 22. The axles 21 are rotatably received in the axial holes 111 and 112 of the seat 1. Provided on an end of the cord winding section 22 is a cord fixing section 23 to which an end of the cord 3 is fixed. The other end of the cord 3 extends through the through-hole 13 of the seat 1 and attached to an object (such as a curtain, Venetian blind, etc.) to be moved upward or downward.

Of more importance, the seat 1 includes two lateral wall extensions 14 and 15 extending from two sides of the end wall 11 adjacent to the through-hole 13 along two lateral sides of the seat 1. Each lateral wall extension 14, 15 preferably has a length greater than a distance between the through-hole 13 and the end wall 11 of the seat 1.

Figure 5:
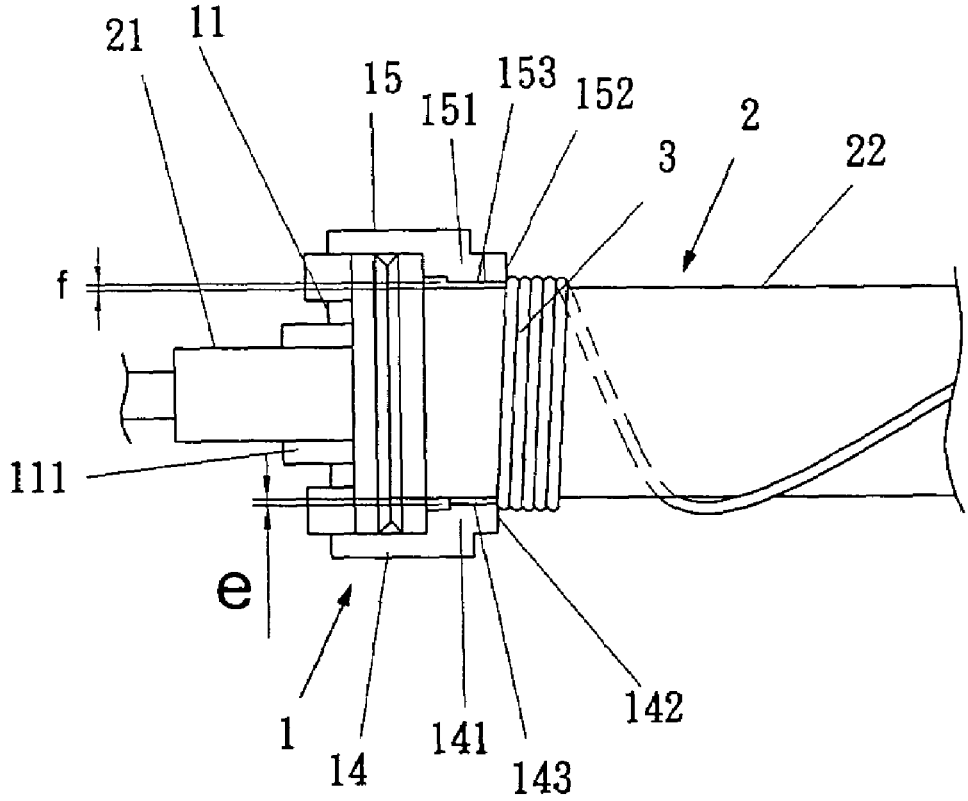
FIG. 5 is a top view of the cord seat assembly in FIG. 4.
Figure 6:
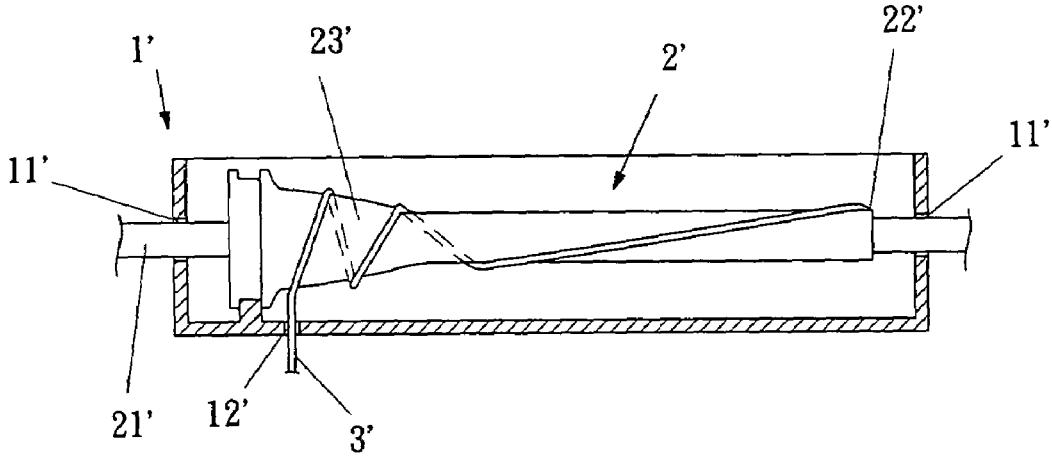
F I G . 6 (PRIOR ART)
FIG. 6 is a sectional view of a conventional cord seat assembly.

The lateral wall extension 14 includes a guiding section 141 that has a guiding face 142 facing the cord fixing section 23 on the end of the spool 2. Further, the guiding section 141 of the lateral wall extension 14 includes an inner face 143 facing the other end of the spool 2. Preferably, a distance "e" (FIG. 5) between the inner face 143 of the guiding section 141 of the lateral wall extension 14 and an outer periphery of the spool 2 is smaller than a diameter of the cord 3, preferably smaller than a radius of the cord 3.

Similar, the lateral wall extension 15 includes a guiding section 151 that has a guiding face 152 facing the cord fixing section 23 on the end of the spool 2. Further, the guiding section 151 of the lateral wall extension 15 includes inner face 153 facing the other end of the spool 2, preferably, a distance "f" (FIG. 5) between the inner face of the guiding section 151 of the lateral wall extension 15 and the outer periphery of the spool 2 is smaller than a diameter of the cord 3, preferably smaller than a radius of the cord 3.

Figure 2:
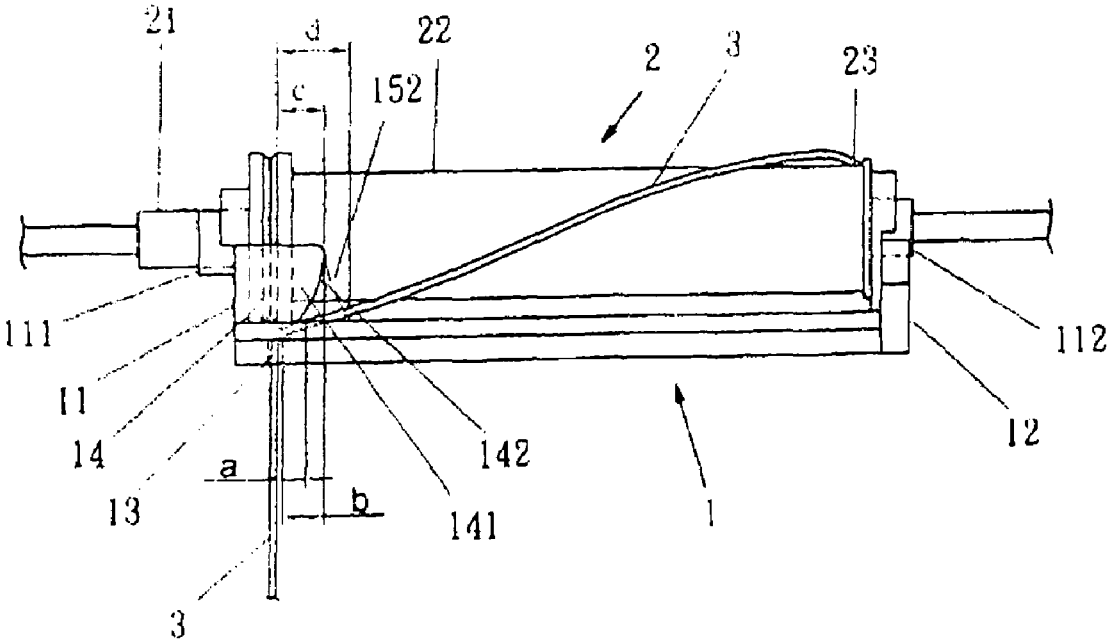
FIG. 2 is a side view of the cord seat assembly in accordance with the present invention.

Preferably, an axial distance between the guiding face 142 and the through-hole 13 increases gradually upward. In other words an axial distance between a relatively upper point on the guiding face 142 and the through-hole 13 is greater than that between a relatively lower point on the guiding face 142 and through-hole 13 (a<b), as shown in FIG. 2.

Further, an axial distance between the guiding face 152 and the through-hole 13 increases gradually downward. In other words, an axial distance between a relatively upper point on the guiding face 152 and the through-hole 13 is smaller than that between a relatively lower point on the guiding face 152 and the through-hole 13 (c<d), as shown in FIG. 2

Figure 3:
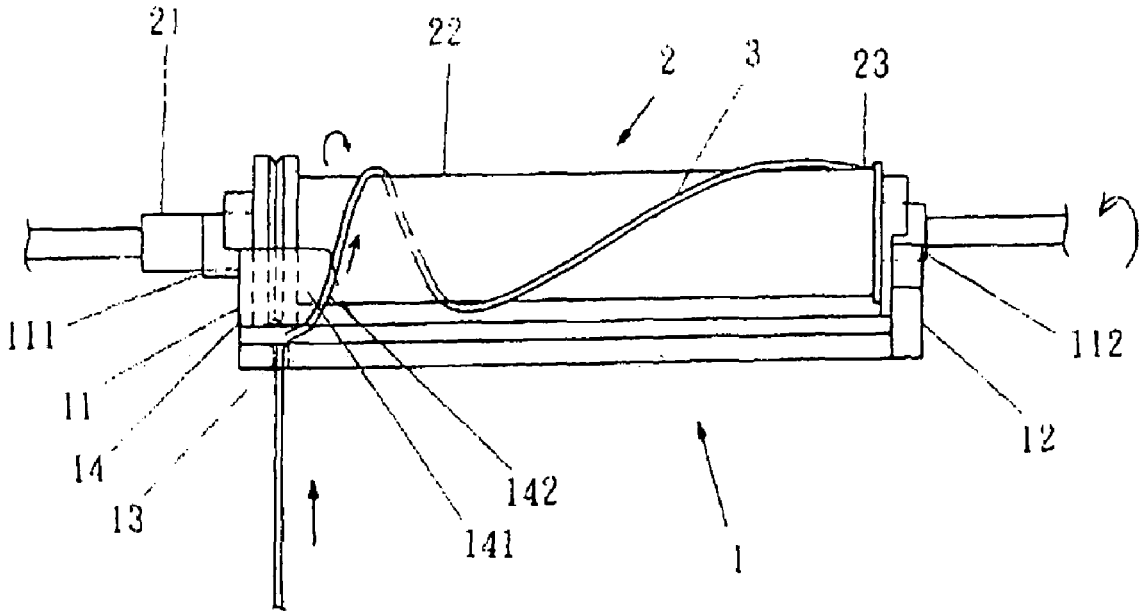
FIG. 3 is a side view similar to FIG. 2, illustrating rotation of a spool of the cord seat assembly in a retrieving direction of a cord.
Figure 4:
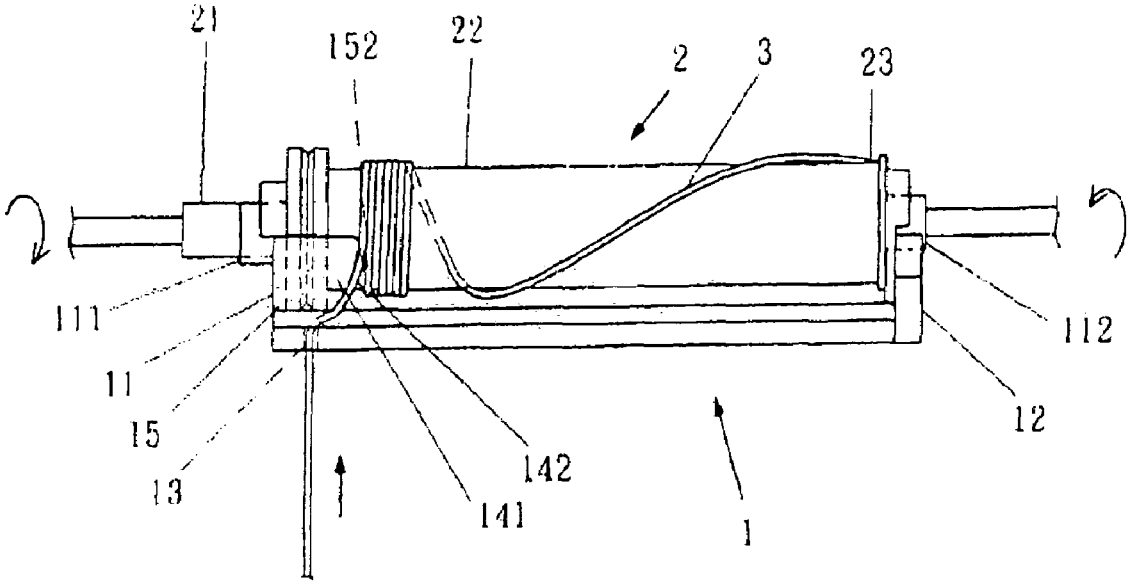
FIG. 4 is a side view similar to FIG. 3, illustrating further rotation of the spool in the retrieving direction of the cord.

Referring to FIG. 3, when the spool 2 is turned in a retrieving direction of the cord 3, the cord 3 that has passed through the through-hole 13 abuts against and guided by the guiding face 142 of the lateral wall extension 141. When the spool 2 is further turned, the cord 3 comes into contact with and is thus guided by the guiding face 152 of the lateral wall extension 151. The cord 3 is thus guided so as to be wound around the winding section 22 of the spool in a smooth manner while avoiding the cord 3 from overlapping or getting stuck. Since the distance "e", "f" (FIG. 5) between the inner face 143, 153 of the guiding section 141, 151 of the lateral wall extension 14, 15 and the outer periphery of the spool 2 is smaller than a diameter of the cord 3, the cord 3 is prevented from getting stuck in the gap between the spool 2 and the guiding section 141, 151. The overall size of the cord seat assembly is smaller than the conventional design, which allows more application of the cord seat assembly from the standpoint of the installation location.

The guiding section 151 may be omitted without sacrificing the advantages of smooth operation and sticking-prevention. Further, the spool 2 may be of other shape and include an embossed outer periphery.

Although a specific embodiment has been illustrated and described, numerous modifications and variations are still possible without departing from the essence of the invention. The scope of the invention is limited by the accompanying claims.

What is claimed is:

1. A cord seat assembly comprising:

a seat comprising an end wall, the seat further comprising a through-hole in a bottom thereof;

a spool rotatably supported by the seat, the spool including a first end and a second end; and a cord extending through the through-hole of the seat, the cord being wound around the spool and including an end fixed to the first end of the spool, the cord being movable along a retrievable direction and a releasing direction;

the end wall of the seat comprising a lateral extension wall extending from a side of the end wall along a lateral side of the seat, the lateral extension wall being adjacent to the through-hole and including a guiding face facing the second end of the spool;

wherein the cord that has passed through the through-hole abuts against and is guided by the guiding face onto the spool when the spool is turned in the retrieving direction of the cord;

wherein the end wall of the seat comprises another lateral extension wall extending from another side of the end wall opposite to the side of the end wall along another lateral side of the seat opposite to the lateral side of the seat, said another lateral extension wall guiding the cord that has passed through the through-hole onto the spool when the spool is turned in the retrieving direction of the cord, wherein an axial distance between a relatively upper point on the guiding face of said another lateral extension wall and the through-hole is smaller than that between a relatively lower point on the guiding face on said another lateral extension wall and the through-hole.

2. A cord seat assembly comprising:

a seat comprising an end wall, the seat further comprising a through-hole in a bottom thereof;

a spool rotatably supported by the seat, the spool including a first end and a second end; and a cord extending through the through-hole of the seat, the cord being wound around the spool and including an end fixed to the first end of the spool, the cord being movable along a retrievable direction and a releasing direction;

the end wall of the seat comprising a lateral extension wall extending from a side of the end wall along a lateral side of the seat, the lateral extension wall being adjacent to the throughhole and including a guiding face facing the second end of the spool;

wherein the cord that has passed through the through-hole abuts against and is guided by the guiding face onto the spool when the spool is turned in the retrieving direction of the cord, wherein the end wall of the seat comprises another lateral extension wall extending from another side of the end wall opposite to the side of the end wall along another lateral side of the seat opposite to the lateral side of the seat, said another lateral extension wall including a guiding face facing the second end of the spool, the guiding face of said another lateral extension wall guiding the cord that has passed through the through-hole onto the spool when the spool when the spool is turned in the retrieving direction of the cord, wherein the guiding face of said another lateral wall extension includes an inner face facing the second end of the spool, and wherein a distance between the inner face of the guiding section of said another lateral wall extension and an outer periphery of the spool is smaller than a diameter of the cord.

3. A cord seat assembly comprising:

a seat comprising an end wall, the seat further comprising a through-hole in a bottom thereof;

a spool rotatably supported by the seat, the spool including a first end and a second end; and a cord extending through the through-hole of the seat, the cord being wound around the spool and including an end fixed to the first end of the spool, the cord being movable along a retrieving direction and a releasing direction;

the end wall of the seat comprising a lateral extension wall extending from a side of the end wall along a lateral side of the seat, the lateral extension wall being adjacent to the through-hole and including a guiding face facing the second end of the spool;

wherein the cord that has passed through the through-hole abuts against and is guided by the guiding face onto the spool when the spool is turned in the retrieving direction of the cord;

wherein the end wall of the seat comprises another lateral extension wall extending from another side of the end wall opposite to the side of the end wall and along another lateral side of the seat opposite to the lateral side of the seat, said another lateral extension wall including a guiding face facing the second end of the spool, the guiding face of said another lateral extension wall guiding the cord that has passed through the through-hole onto the spool when the spool is turned in the retrieving direction of the cord;

wherein an axial distance between a relatively upper point of the guiding face of said another lateral extension wall and the through-hole is smaller than that between a relatively lower point on the guiding face on said another lateral extension wall and the through-hole.

4. A cord seat assembly comprising:

a seat comprising an end wall, the seat further comprising a through-hole in a bottom thereof;

a spool rotatbly supported by the seat, the spool including a first end and a second end; and a cord extending through the through-hole of the seat, the cord being wound around the spool and including an end fixed to the first end of the spool, the cord being movable along a retrieving direction and a releasing direction;

the end wall of the seat comprising a lateral extension wall extending from a side of the end wall along a lateral side of the seat, the lateral extension wall being adjacent to the through-hole and including a guiding face facing the second end of the spool;

wherein the cord that has passed through the through-hole abuts against and is guided by the guiding face onto the spool when the spool is turned in the retrieving direction of the cord;

wherein the end wall of the seat comprises another lateral extension wall extending from another side of the end wall opposite to the side of the end wall and along another lateral side of the seat opposite to the lateral side of the seat, said another lateral extension wall including a guiding face facing the second end of the spool, the guiding face of said another lateral extension wall guiding the cord that has passed through the through-hole onto the spool when the spool is turned in the retrieving direction of the cord;

wherein a guiding section of said another lateral wall extension includes an inner face facing the second end of the spool, and wherein a distance between the inner face of the guiding section of said another lateral wall extension and an outer periphery of the spool is smaller than a diameter of the cord.

* * * * *

UNITED STATES PATENT AND TRADEMARK OFFICE

CERTIFICATE OF CORRECTION

PATENT NO. : 7,210,646 B2
APPLICATION NO. : 11/114852
DATED : May 1, 2007
INVENTOR(S) : Mu-Chuan Hsu It is certified that error appears in the above-identified patent and that said Letters Patent is hereby corrected as shown below:

Title Page Item [76]

Delete the name "Mu-Chuam Hsu" and insert therefor the name

--Mu-Chuan Hsu--.

Signed and Sealed this

Twentieth Day of January, 2009

JON W. DUDAS
*Director of the United States Patent and Trademark Office*